US005203509A

United States Patent [19]

Bieg

[11] Patent Number: 5,203,509

[45] Date of Patent: Apr. 20, 1993

[54] VORTEX NOZZLE FOR SEGMENTING AND TRANSPORTING METAL CHIPS FROM TURNING OPERATIONS

[75] Inventor: Lothar F. Bieg, Louisville, Colo.

[73] Assignee: The United State of America as represented by the United States Department of Energy, Washington, D.C.

[21] Appl. No.: 862,885

[22] Filed: Apr. 3, 1992

[51] Int. Cl.[5] ..... B02C 23/26; B02C 19/06; B05B 1/34

[52] U.S. Cl. ..... 239/405; 239/463; 239/143; 241/29

[58] Field of Search ..... 239/423–425.5, 239/399, 403–406, 416.4, 416.5, 417, 417.3, 461, 463, 487, 8, 143, 654; 241/5, 39, 320; 15/409

[56] References Cited

U.S. PATENT DOCUMENTS

| | | | |
|---|---|---|---|
| 2,609,233 | 9/1952 | Stearman | 239/DIG. 21 X |
| 3,028,103 | 3/1962 | Fisher | 241/5 |
| 3,304,012 | 2/1967 | Sem | 239/405 |
| 3,584,797 | 6/1971 | Stephanoff | 241/5 |
| 3,615,053 | 10/1971 | Pease et al. | 239/399 X |
| 3,633,825 | 1/1972 | Waldron | 239/423 X |
| 3,741,485 | 6/1973 | Gage et al. | 241/39 |
| 3,829,027 | 8/1974 | Mocarski | 239/417.3 X |
| 4,055,870 | 11/1977 | Furutsutsumi | 15/409 |
| 4,176,798 | 12/1979 | Talbott et al. | 241/39 |
| 4,186,772 | 2/1980 | Handleman | 241/39 X |
| 4,219,164 | 8/1980 | Taylor | 241/5 |
| 4,533,704 | 11/1985 | Wilson et al. | 241/39 |
| 4,928,885 | 5/1990 | Nalcao | 239/417 |

FOREIGN PATENT DOCUMENTS

| | | | |
|---|---|---|---|
| 528315 | 10/1920 | France | 239/405 |
| 544935 | 7/1922 | France | 239/416.5 |

OTHER PUBLICATIONS

"The Development of a Vortex Nozzle" by Lothar F. Bieg—A Production Technology Engineering Report published May 1991 by EG&G Rocky Flats.

*Primary Examiner*—Andres Kashnikow
*Assistant Examiner*—Kevin Weldon
*Attorney, Agent, or Firm*—Anne D. Daniel; James H. Chafin; William R. Moser

[57] ABSTRACT

Apparatus for collecting, segmenting and conveying metal chips from machining operations utilizes a compressed gas driven vortex nozzle for receiving the chip and twisting it to cause the chip to segment through the application of torsional forces to the chip. The vortex nozzle is open ended and generally tubular in shape with a converging inlet end, a constant diameter throat section and a diverging exhaust end. Compressed gas is discharged through angled vortex ports in the nozzle throat section to create vortex flow in the nozzle and through an annular inlet at the entrance to the converging inlet end to create suction at the nozzle inlet and cause ambient air to enter the nozzle. The vortex flow in the nozzle causes the metal chip to segment and the segments thus formed to pass out of the discharge end of the nozzle where they are collected, cleaned and compacted as needed.

4 Claims, 2 Drawing Sheets

VORTEX NOZZLE FOR SEGMENTING AND TRANSPORTING METAL CHIPS FROM TURNING OPERATIONS

RIGHTS OF THE GOVERNMENT

The United States Government has rights in this invention pursuant to Contract No. DE-AC04-90DP62349 between the U.S. Department of Energy and EG & G Rocky Flats, Inc. for operation of the Department's Rocky Flats Plant.

BACKGROUND OF THE INVENTION

According to a commonly used method or process for metal removal by means of a lathe, a single pointed cutting tool is mounted within a tool holder and guided by mechanical slides to interface with a workpiece which has been mounted within a fixture and rotated against the cutting tool. This process, which is commonly referred to as turning, normally results in the removal of an elongated ribbon of metal originating at the cutting tool tip which will be referred to herein as a "chip". A long and stringy chip is most likely to be formed during the turning of soft or ductile materials.

Theoretically during a single machining "pass" a chip is produced whose volume equals the surface area of the workpiece times the depth of cut of the cutting tool. Since only a small portion of the total surface of the workpiece is removed in a single revolution, overall chip lengths can become very long and often exceed many feet in length. Often, the chip forms into a ball or curls around the cutting tool or tool post and can damage the workpiece surface if not removed manually or through the use of a mechanical or hydraulic chip breaker. Mechanical chip breakers are used for some materials and usually take the form of an obstacle formed into or mounted onto the tool, posing an obstruction to the chip flow, breaking the chip into smaller sections. Mechanical obstacles are normally simple in design and tend to produce non-uniform chip segments. Hydraulic chip breaking is also used for some materials, whereby a high pressure stream of coolant is directed straight to the cutting zone breaking the chip into very small segments. The use of hydraulic streams requires recovery of the hydraulic fluid for recycle to minimize costs and to meet environmental concerns. Soft or ductile chips are not easily broken and operator action is frequently required. Chip removal is normally accomplished with these materials by pulling the chip away from the cutting zone as it is generated using tweezers or a hook to engage the chip.

SUMMARY OF THE INVENTION

It is a general object of the invention to provide apparatus for collecting, segmenting, and conveying metal chips from turning operations.

A more particular object of the invention is to provide apparatus for segmenting metal chips from turning operations without the use of hydraulic fluid and wherein the chips are segmented in uniform segments.

These and other objects are met in accordance with the present invention through the use of a compressed gas driven vortex nozzle for receiving the metal chips and twisting it to cause the chip to segment through the application of torsional forces to the chip. The vortex nozzle of the present invention is tubular in shape with a discharge end and an inlet end for receiving ambient air which assists in transfer of the metal chip from a lathe cutting tool to the nozzle. The angular discharge of compressed gas within the nozzle creates a vortex effect which influences ambient air entering the nozzle and compressed gas discharging through an annular inlet at the intake end of the nozzle, thereby causing the ambient air and compressed air discharged through the annular inlet to enter into a vortex flow mode. This vortex flow causes the metal chip to segment and the segments thus formed to pass out of the discharge end of the nozzle where they are collected, cleaned and compacted as needed.

DETAILED DESCRIPTION OF PREFERRED EMBODIMENT

Figure 1:
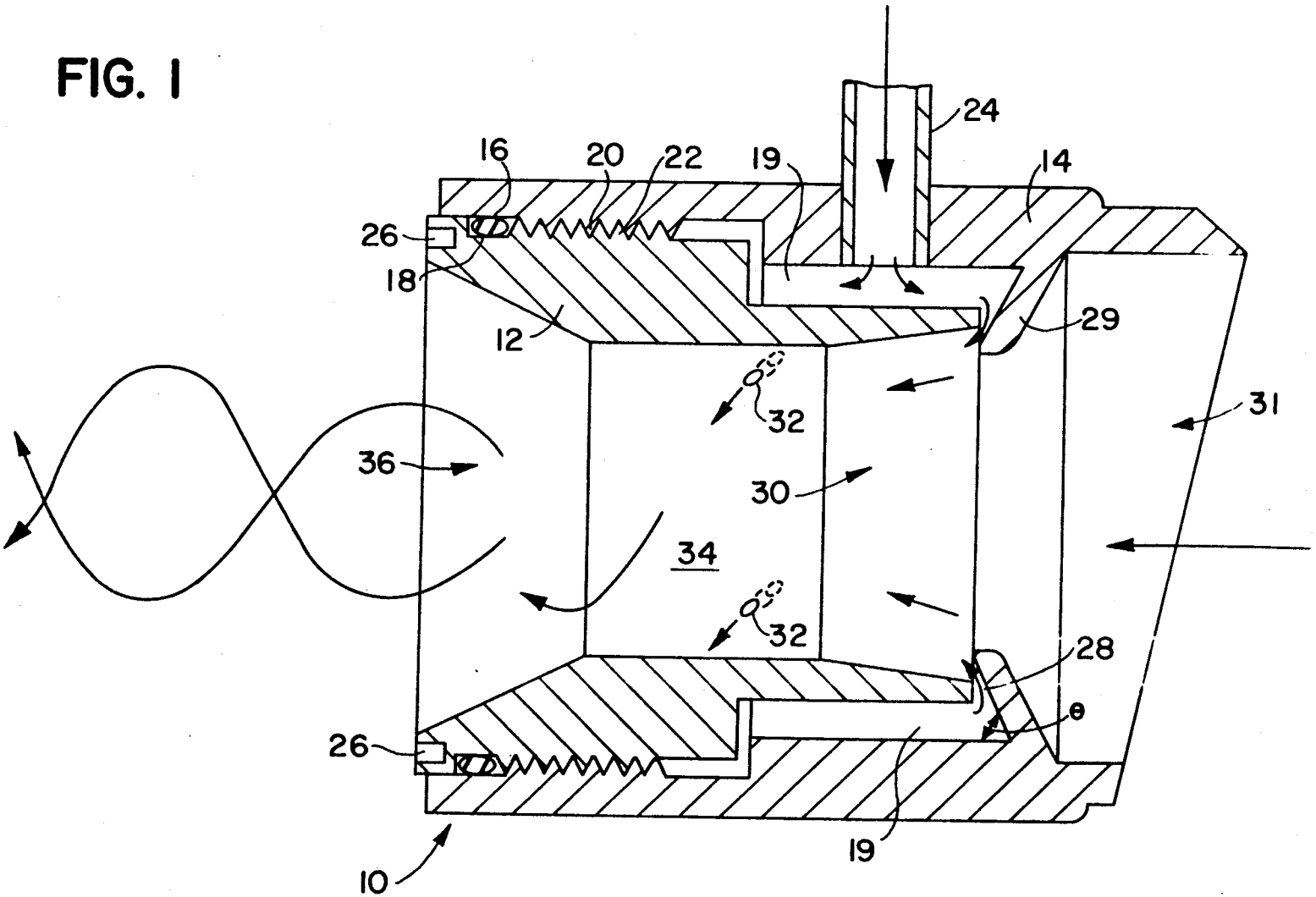
FIG. 1 is an enlarged cross sectional view of a vortex nozzle made in accordance with the invention.

Referring now to FIG. 1, a vortex nozzle 10 is shown in cross section with an annular inner assembly 12 threadably engaging annular outer assembly 14 in a coaxial relationship. O-ring 16 is provided in annular groove 18 to seal inner and outer assemblies 12 and 14 to each other and to thereby prevent loss of compressed air from annular chamber 19 through threads 20 and 22. Compressed gas is injected into chamber 18 through pipe means 24 in communication with a source of pressurized gas (not shown) for powering nozzle 10 as will be explained below.

Adjustment holes 26 are provided at the end of inner assembly 12 for receiving a retaining ring tool which can be used to turn the inner assembly 12 relative to outer assembly 14, thereby moving the inner assembly axially into or out of the outer assembly by virtue of the pitch of threads 20 and 22. This allows for precise adjustment of the width of annular opening 28 which results in a corresponding change in the discharge of compressed air from chamber 18 therethrough as illustrated by flow arrows in FIG. 1. Increased flows through opening 28 provide corresponding increases in the suction force and total gas consumption of the vortex nozzle. As shown, an angled collar or flange 29 formed in outer assembly 14 directs the air discharging through passageway 28 inwardly into the tapered inlet end 30 of inner assembly 12, thereby initiating flow through the nozzle and the creation of a vacuum at the nozzle inlet 31. According to a preferred embodiment of the invention, flange 29 was angled at an angle $\theta$ of 65 degrees relative to the cylindrical wall of assembly 14. The suction force or reduction of pressure at the nozzle inlet 31 causes ambient air to enter the nozzle and mix with the compressed air discharged into the nozzle through passageway 28 and vortex holes 32 described below.

Turning now to the inner assembly 12 of the vortex nozzle, it is seen that a venturi shape is defined by a tapered inlet 30, an untapered cylindrical throat section 34 and a tapered discharge portion 36. This specific shape causes a drop in pressure and an increase in velocity as a fluid or gas flows through it. Furthermore, four individual vortex holes 32 (two shown) are machined into the inner assembly 12 to provide fluid communication with the compressed gas in annular chamber 19. In one preferred embodiment of the invention having a 0.5 inch diameter throat section 34, each of the vortex holes 32 was fabricated to be angled 30 degrees relative to a plane containing the nozzle center line and offset whereby the center line of each vortex hole intersects that plane 0.2 inch from the nozzle center line. Different numbers of vortex holes, hole arrangements, inclinations and offset dimensions can be used without deporting from the spirit and scope of the invention, however. Also, in a preferred embodiment, hole sizes of 0.04 in. diameter were used and the holes were spaced 90 degree apart. Nozzles having vortex holes 32 arranged at the same axial location in the nozzle and aimed so as to intersect the nozzle center line at a single point and also arranged in a spiral fashion to intersect the nozzle center line sequentially were tested but were found to be less effective than the preferred embodiment described above in developing suction and for segmenting metal chips.

A vortex nozzle substantially as shown in FIG. 1 having a 0.5 in. throat diameter and an inlet section 30 tapered at 27 degrees was tested using compressed air in annular chamber 19 maintained at 80 pounds per square inch. Initially, inner assembly 12 was advanced within outer assembly 14 to close off passageway 28, thereby limiting discharge of the compressed air to vortex holes 32. Each of the vortex holes discharged a pressurized stream of gas at high speed to create a spiral like vortex flow in the direction of the nozzle discharge end 36. This vortex motion of the gas discharged through vortex holes 32 acts on a metal chip passing through the nozzle causing it to twist and break into small sections.

Although the vortex action created by discharge of compressed gas through vortex holes 32 creates suction at the inlet end 31 of the nozzle through collision with free gas molecules in the nozzle and the resultant acceleration of those molecules toward the discharge end of the nozzle, additional vacuum is desirable to enhance collection of the continuous chip from the cutting tool to the nozzle. This additional vacuum or suction was created by rotating inner assembly 12 relative to outer assembly 14, thereby opening passageway 28 so that part of the compressed gas in annular chamber 19 could pass into the inlet end 30 of inner assembly 12 where it strikes free gas molecules and accelerates them through the nozzle. Suction created by flow through passageway 28 is the primary force to attract and collect the chip as it comes off of the cutting tool.

Due to the inclination of flange 29 as shown in FIG. 1, the gas flow through passageway 28 is directed toward the center of the vortex nozzle and towards discharge end 36. All gas discharging through passageway 28 and entering through inlet 31 flows through the nozzle in a semi axial flow until it meets the gas discharging from vortex holes 32 and joins it in vortex flow. This flow attracts and transports the chip and guides it into the nozzle where chip breaking takes place as a result of torsional forces being exerted on the chip by the vortex flow.

Figure 2:
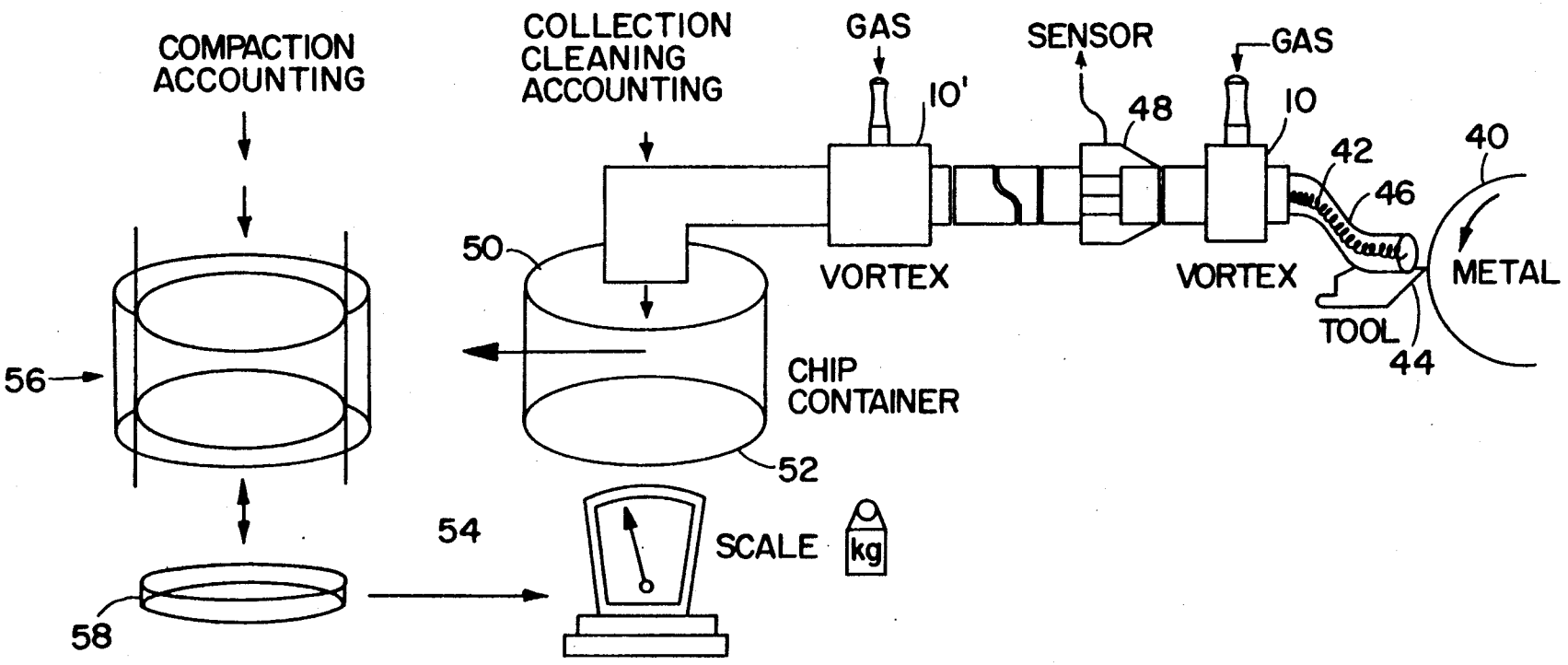
FIG. 2 is a schematic drawing illustrating a chip handling system incorporating two vortex nozzles as shown in FIG. 1.

Turning now to FIG. 2, a system for chip handling is schematically shown which encompasses chip management from its point of origin at workpiece 40 through the collection, breaking, and compaction of chip segments. As shown, chip 42 is produced through the cutting action of cutting tool 44 on workpiece 40 and travels through conduit 46 to a vortex nozzle 10 substantially as described above in reference to FIG. 1. A chip sensor 48 is located downstream of vortex nozzle 10 for verifying the presence of the chip segments or a continuous chip where the desired chip breakage has not occurred. Good functioning of the system is verified where an alternating signal is received from the sensor as would be expected where a stream of chip segments pass the sensor in the discharge stream from nozzle 10. On the other hand, a continuous signal indicates that the chip is passing through the nozzle without being broken and no signal at all indicates that the chip is not being collected and passed through the vortex nozzle.

A second vortex nozzle 10 has been incorporated into the particular embodiment shown in FIG. 2 to assist the first vortex nozzle 10 with increased suction. Since the chip segments are normally contaminated with liquid coolant used in the cutting operation, the second vortex nozzle may be used to blow off excess coolant adhering to the chip segments. this is performed by mounting the second vortex nozzle close to a chip collection container 50 which is fitted with a sieve 52 allowing the liquid to separate from the chips, whereby only the chips are retained in the collection container.

In the event that a solvent is required to clean the chip segments, the solvent can be injected into the compressed gas supply of the second vortex in an atomized form, thereby becoming part of the vortex, blowing upon the chips as they pass through the second vortex nozzle and further on those chips contained in the chip collection container. Where material inventory is important, the collected chips in chip collection container 50 may be weighed on a suitable scale 54 either before or after a compaction step 56 is performed to produced a reduced volume 58 of compacted chip segments.

From the foregoing description, one skilled in the art can easily ascertain the essential characteristics of this invention without departing from the spirit and scope thereof and can make various changes and modifications to adjust it to various usages and conditions. For example, the vortex nozzle as taught herein can be used for purposes other than chip collection and breakage. The vortex action and vacuum provided thereby can be used for various applications where mixing of gases and/or vacuum pumping of material is required. It is intended accordingly that this invention be limited in scope only by the claims appended hereto.

What is claimed is:

1. A compressed gas driven vortex nozzle comprising:

(a) an annular inner assembly defining:

i. a continuous flow passageway having a converging inlet portion with an inlet end, a uniform throat portion and a diverging exhaust portion in continuous fluid communication; and ii. a plurality of vortex holes for discharging compressed gas into said uniform throat portion of said flow passageway, said vortex holes being angled to impart a spiral flow path to said compressed gas discharged therefrom whereby said gas has both circumferential and downstream flow components so as to produce vortex flow in said flow passageway downstream of said vortex holes;

(b) an annular outer assembly concentrically surrounding said inner assembly, said inner and outer assemblies defining:

i. an annular chamber for receiving compressed gas, said annular chamber being in fluid communication with said vortex holes for providing compressed gas to be discharged through said holes, and ii. an annular discharge passageway surrounding the inlet end of said converging inlet portion of said flow passageway, said annular discharge passageway being in fluid communication with said annular chamber and positioned to discharge compressed gas into said inlet portion wherein said compressed gas has both radial and downstream flow components so as to induce flow of ambient air into said inlet portion.

2. The vortex nozzle of claim 1 wherein said inner assembly is axially adjustable relative to said outer assembly so as to adjust the width of said annular discharge passageway.

3. The vortex nozzle of claim 2 wherein said inner and outer assemblies are threadably engaged so as to permit said axial adjustment by rotation of said inner assembly relative to said outer assembly.

4. The apparatus of claim 1 wherein said outer assembly includes an inwardly angled flange portion extending inwardly past the inlet end of said inlet portion, said flange and said inlet end being spaced apart axially to define said annular discharge passageway, said flange directing compressed gas discharging through said annular discharge passageway so as to provide both radial and downstream flow components to said discharged gas.

* * * * *